United States Patent [19]

Hassel et al.

[11] Patent Number: 4,801,021

[45] Date of Patent: Jan. 31, 1989

[54] MULTI-LINE PAPER FEEDING ASSEMBLY

[75] Inventors: H. Charles Hassel, Los Angeles; Donald Westland, Venice, both of Calif.

[73] Assignee: MicroComputer Accessories Inc., Los Angeles, Calif.

[21] Appl. No.: 108,230

[22] Filed: Oct. 14, 1987

[51] Int. Cl.[4] ..... B41J 15/04

[52] U.S. Cl. ..... 211/45; 400/613; 400/613.2

[58] Field of Search ..... 211/46, 51; 271/9; 400/613.2, 613, 618

[56] References Cited

U.S. PATENT DOCUMENTS

| | | | |
|---|---|---|---|
| 1,821,528 | 9/1931 | Smith . | |
| 1,876,777 | 9/1932 | Smith . | |
| 1,917,635 | 7/1933 | Degener . | |
| 1,974,941 | 9/1934 | Workman . | |
| 2,052,583 | 9/1936 | Sherman . | |
| 2,587,827 | 3/1952 | Fleischmann . | |
| 2,760,288 | 8/1956 | Shoenfeld | 211/45 X |
| 4,408,916 | 10/1983 | Burgert | 400/613.2 |
| 4,515,490 | 5/1985 | Marker, III | 400/613.2 |
| 4,619,388 | 10/1986 | Ono et al. | 226/76 |
| 4,655,626 | 4/1987 | Okazaki | 400/605 |
| 4,717,273 | 1/1988 | Elderfield | 400/613.2 |

FOREIGN PATENT DOCUMENTS 2131352 6/1984 United Kingdom .

OTHER PUBLICATIONS

Duo-Mobile Multifeed Printer Catalog Page. Address, page number & date Unknown.

Catalog Page, Milas Buroakustik, Heidleberger, Landstra Be 175A D-6100 Darmstadt Date Unknown.

Catalog. Desk Top Printer Stand, Acco International Inc., 770 S. Acco Plaza, Wheeling, Ill. 60090-6070. Jan. 1985.

Catalog page showing multifeed printer stand. Rexel Company. Proper name of company is unknown. Address, page number and date also unknown.

*Primary Examiner*—Robert W. Gibson, Jr.

*Attorney, Agent, or Firm*—Richard B. O'Planick

[57] ABSTRACT

A paper feeding assembly for printers or the like is disclosed comprising a base plate (4) and a clamping bar (30). The base plate (4) is adapted to have at least one transverse channel (12) of substantially V-shaped transverse profile defined by a vertical rearward sidewall (14) and a forwardly inclined front sidewall (16). Each channel tapers from a relatively wide top opening (44) to a relatively narrow bottom opening (42). An elongate clamping bar 30) resides within the channel and an intermediate portion (32) of the bar pivots about opposite end portions (34) to clamp a continuous length of paper against the forwardly inclined channel sidewall (16). Forwardly extending support pads (8), (10) support the printer, whereby the rearward base plate portion (6) can be suspended from the edge of a work surface in cantilever fashion.

18 Claims, 2 Drawing Sheets

MULTI-LINE PAPER FEEDING ASSEMBLY

TECHNICAL FIELD

This invention relates in general to paper managing systems for office equipment. More specifically, the invention pertains to multi-line paper feeding assemblies for use in conjunction with a computer system printer or the like.

BACKGROUND ART

Paper managing devices are relatively well known for office use in conjunction with computer printers. In particular, typical paper managing systems consist of a mechanism for organizing and directing multiple lines of computer paper to a printer into which one of the paper lines is fed at a time. The specific paper lines can vary in size, (e.g. 4¼" wide adhesive labels on backing versus 14⅞" wide column paper) or vary in format (e.g. lined versus unlined). Since it is necessary from time to time to alter the paper style or size inputting into a printer, paper handling assemblies have been developed to maintain the various paper lines in an organized manner so that any line of paper can be selected and routed into the printer when needed.

Attempts by the industry to develop an acceptable paper managing system as a printer accessory have not been entirely successful. One approach taken to develop such an assembly has been to use a multi-channeled templet having a series of parallel slots thereto for receiving the multiple lines of paper. Each channel is sized to closely admit one paper line, and a separate device is used for preventing the paper from dropping out of the channel when that paper line is not in use. For example, one manufacturer recommends the use of paper clips attached to the terminal ends of the paper in order to prevent the paper from dropping out of the channel. While this attempt at a solution to the industry's needs is theoretically functional, several shortcomings prevent it from representing an ideal solution. For example, relying upon a paper clips to prevent the paper from dropping out of the channel slots is not dependable, as such paper clips often become disattached and lost. Further, disassociated clips may end up being lodged in the nearby printer causing property damage.

Other approaches to solving the market's needs have centered around relatively complex apparatus having a mechanical biasing means for holding the paper within the routing channels. While such complicated mechanisms are functional, they are relatively expensive and are subject to breakdowns requiring mechanical maintenance. Accordingly, complex mechanisms for multi-line paper management have proven unsatisfactory.

In summary, the industry's need for an inexpensive, simple, yet dependable multi-line paper managing assembly for routing multiple lines of continuous paper to a printer location have not been achieved by the prior art. As printers become more versatile and are expected to handle a wider range of paper sizes and formats, the need for such a paper managing device grows.

BRIEF DESCRIPTION OF THE INVENTION

The subject invention overcomes the deficiencies present in the prior art by providing a multi-line paper managing assembly consisting of two major components. The assembly comprises a base plate having a series of parallel profiled channels extending therethrough, each of which being adapted to accommodate receipt of a respective line of continuous paper. Each channel is configured to have a substantially a V-shaped transverse profile tapering from a top opening to a relatively narrow bottom opening. The channel is defined by a rearward vertical sidewall and an upwardly inclined forward sidewall.

An elongate clamping bar member is provided for residence within each of the channels, configured having an intermediate elongate portion which is located proximate to the top channel opening, and remote depending legs at opposite ends which extend downward toward the bottom channel opening. The clamping bar ends reside within a groove at opposite ends of the channel, whereby the intermediate bar portion is downwardly pivotable about the ends against the inclined channel sidewall. Accordingly, a length of paper fed through the bottom channel opening and out the top channel opening is pressured by the weight of the intermediate bar portion against the inclined channel sidewall, and is thereby retained within the channel.

Pursuant to the subject invention the intermediate portion of the bar is of a larger diameter than the end portions to prevent the bar from attaining a rotational equilibrium in the vertical orientation. The oversized intermediate portion of the bar interferes with the vertical wall of the channel, and automatically induces the bar into a downward rotation into engagement against the inclined forward surface of the channel.

A forward portion of the paper feeding assembly consists of support pads upon which a computer system printer or like piece of equipment is positioned. When anchored by the printer, the base plate extends outward from an edge of a desk or table in cantilever fashion, freely suspending the channels and making the bottom of the channels readily accessible to the bottom fed lines of paper.

Accordingly, it is an objective of the present invention to provide a multi-line paper management assembly adapted to retain multiple lines of paper in a ready state for selective feed into a computer system printer or the like.

Yet a further objective of the present invention is to provide a multi-line paper feeding assembly consisting of a relatively small number of component parts which require little or no maintenance.

A further objective of the present invention is to provide a multi-line paper feeding assembly which is simple to operate and which has an automatic paper engaging capability.

Still a further objective of the present invention is to provide a multi-line paper feeding assembly which serves to organize multiple lines of paper for input into a printer or the like.

A further objective is to provide a multi-line paper feeding assembly which can position and retain the terminal ends of continuous paper lines in a position proximate to the printer into which any one line of the paper can be fed.

A further objective of the present invention is to provide a multi-line paper feeding assembly which is inexpensive to manufacture, simple to assemble, yet dependable in operation.

These and other objectives, which will be apparent to one skilled in the art, are achieved by a preferred embodiment which is described in detail below, and which is illustrated by the accompanying drawings.

BRIEF DESCRIPTION OF THE ACCOMPANYING DRAWINGS

DETAILED DESCRIPTION OF THE PREFERRED EMBODIMENT

Figure 1:
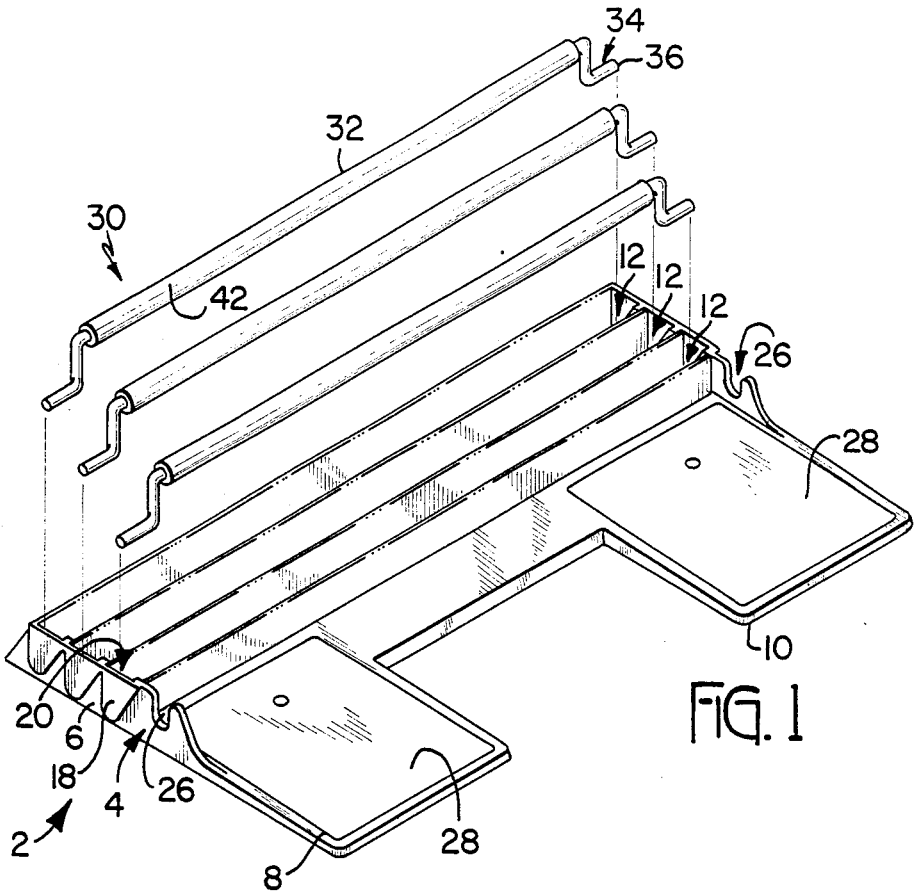
FIG. 1 is an exploded perspective view of a multi-line paper management assembly comprising the subject invention.

With reference initially to FIG. 1, the subject paper management assembly 2 comprises a base plate 4 having a rearward located channel plate portion 6 and spaced apart forward extending support pads 8, 10 extending therefrom. The rearward base plate portion 6 is provided with a plurality of transverse channels 12 which extend from one side of the base plate to the other. It should be appreciated that the base plate 4 can be molded unitarily from conventional plastics material, by manufacturing techniques which are common in the industry.

Figure 2:
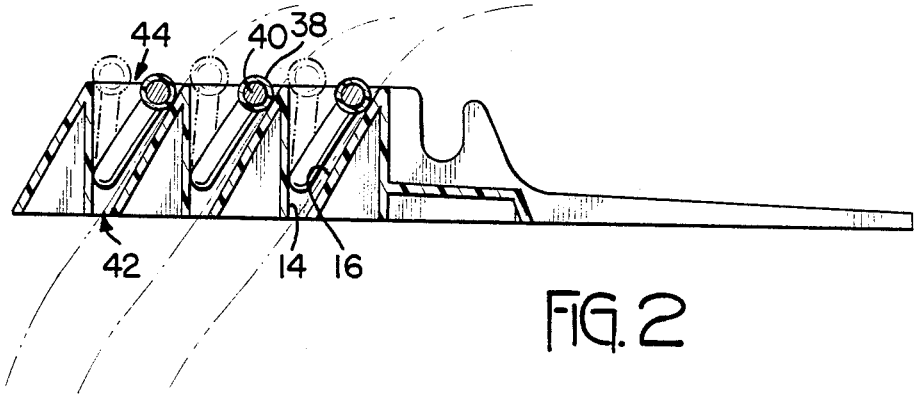
FIG. 2 is a transverse sectional view taken along the line 2—2 of 3.

Each of the channels 12 is defined by a vertical rearward sidewall 14, as best illustrated in FIG. 2, and an upwardly inclined forward sidewall 16. Endwalls 18 are located at opposite ends of each of the channels 12, and each of the endwalls 18 has a receptacle slot 20 formed therein which terminates at a support floor 22. Floor 22 is located approximately two thirds of the way down into the slot. (See FIG. 3.)

Between the rearward channel plate portion 6 and the dual support pads 8 extending forwardly therefrom are a pair of upwardly open slots 26. Slots 26 are intended to receive the power cord and the data cable (from the computer) for a printer which can be positioned upon the forward extending support pads 8, 10. The power cable and the data cable are press fitted into each of the slots 26, and are routed to the side of plate 4, which prevents the cables from interfering with the smooth feed of paper into the printer.

Each of the support pads 8, 10 is provided with a molded-in anti-slip texture 28 on the top surface thereof. As described previously, the support pads 8, 10 are intended to support the printer or like piece of equipment into which one or more of the paper lines are to be fed. The anti-slip surface helps to prevent the printer from migrating during its operation from vibration or the like.

A further component of the subject paper feeding assembly is an elongate clamping bar member 30. Clamping bar member 30 consists of an elongate intermediate portion 32 from which L-shaped dependent end portions 34 extend. Each of the end portions 34 provides a remote horizontal joint 36 which resides in the slots 20 of the channel endwalls 18.

It will be appreciated from a combined consideration of FIGS. 1 and 2 that the clamping bar member 30 has an outer sleeve component 38 surrounding the intermediate bar portion 32 in concentric fashion. The outer sleeve 38 entirely encapsulates the inner core 40 of the bar member intermediate portion 32, as seen in FIG. 2. The outer sleeve 32 is composed of a high coefficient of friction material, such as rubber. A longitudinal slit 42 is provided along and through the outer sleeve 32 to enable the inner core 40 to be inserted therein.

Figure 3:
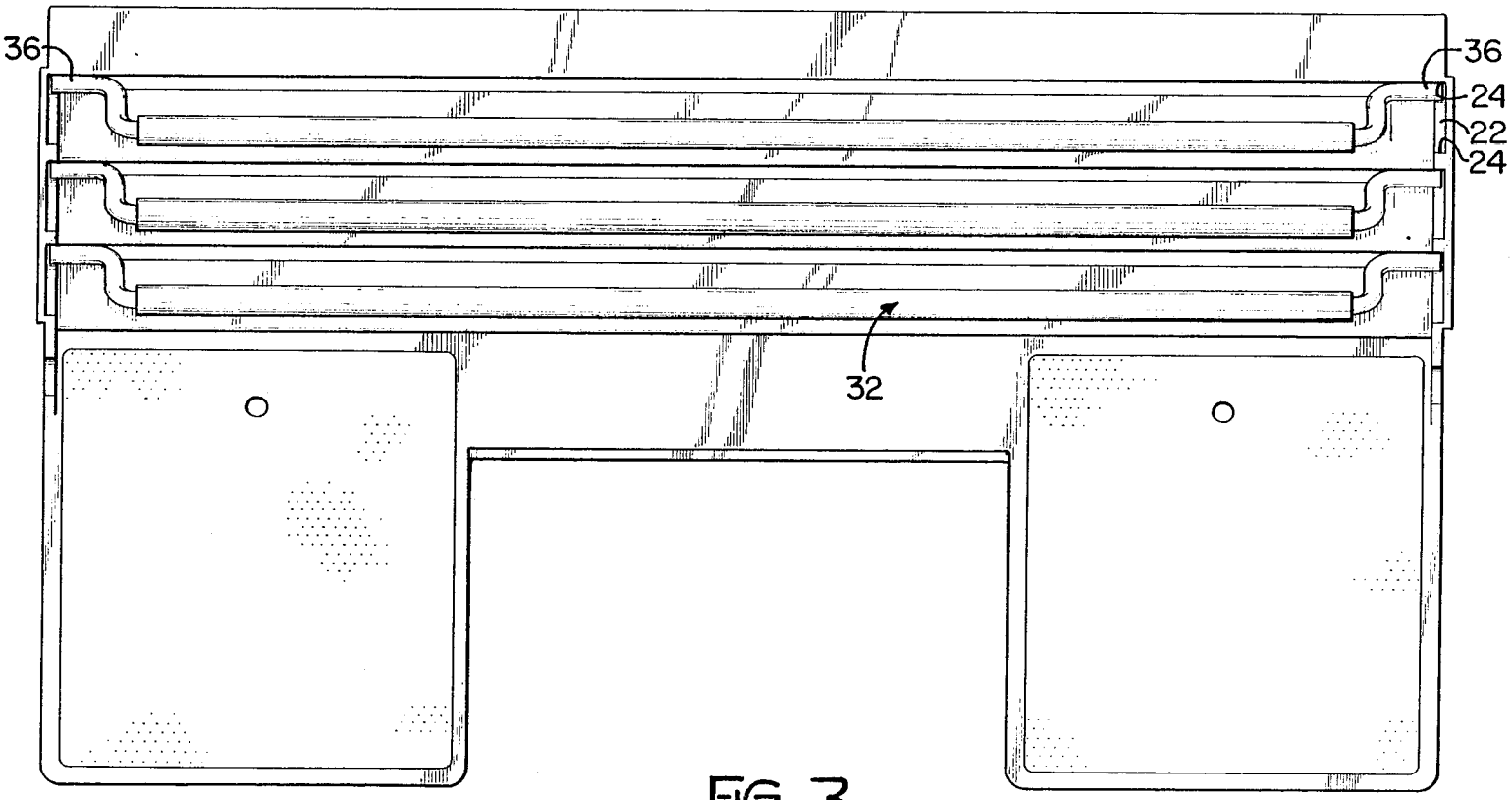
FIG. 3 is a top plan view of the subject paper feeding assembly illustrating the clamping bar members in the clamping position within their respective channels.

Operation of the subject invention will be appreciated from a combined viewing of FIGS. 1, 2, and 3. As stated previously, the elongate bar member 30 is inserted into each of the channels 12 of the base plate 4. The horizontal joints 36 of the clamping bar member are located within the receptacle slots 20 of the channel, and rest upon the support floor 22 thereof. When situated into position within the channel, the intermediate portion 32 of the bar member 30 is located proximate to the relatively wide upper opening of the channel, and the remote depending end portions 34 of the clamping bar are relatively proximate to the narrow constrictive bottom opening of the channel.

With the horizontal joints 36 located upon the floor 22 of the receptacle slots 20, the clamping bar intermediate portion 32 is free to rotate downward under influence of gravity about the end portions 36. As will be appreciated from FIG. 2, the intermediate portion 32 can rotate from a nearly vertical first position, shown in phantom, to a secondary position against the inclined forward surface 16 of the channel. It will further be appreciated that the relatively oversized diameter of the intermediate portion 32, attributable to the presence of the outer sleeve 38, prevents the clamping bar from achieving a true vertical orientation as intermediate portion 32 engages channel sidewall 14. Accordingly, the clamping bar can never achieve rotational equilibrium against sidewall 14 but must always rotate downwardly therefrom. Rotation of the bar downward under influence of gravity automatically causes intermediate portion 32 to engage against the inclined forward sidewall 16 of the channel.

Prior to inserting paper into base plate portion 6, the bar members are either rotated away from surfaces 16 or removed entirely from the top openings of the channels. Several lines of continuous paper are routed through the base plate 4 channels from the bottom as shown in FIG. 2. The paper enters the relatively narrow bottom openings 42 of the channels and exits out of the relatively large top openings 44.

If the clamping bar members have been removed they are reinserted into the channels so that the paper is situated between the bar members and the inclined channel surfaces 16. As the clamping bar member 30 automatically rotates downward, the intermediate portion 32 of the bar member engages against the paper and the weight of intermediate portion 32 pressures the paper against the inclined forward sidewall 16 of the channel. Because of the rubber sleeve 32 which surrounds intermediate portion 32, the paper is frictionally prevented from falling out of the bottom opening 42 of the channel, and is held in position for use by the printer. Since the printer is located proximate to the paper lines, namely upon forward extending support pads 8, 10, the ends of the paper lines are conveniently located for selective introduction into the printer. When one line of paper is in use, the other lines are clamped by their respective clamping bars within respective channels in close proximity to the printer until needed.

From the foregoing, it will be appreciated that the subject paper managing assembly is simple and relatively inexpensive to manufacture. The base plate 4 is composed of commonly available plastics material and is manufactured by conventional molding techniques. The clamping bar member 30 consists of an elongate steel bar which is formed at opposite ends in the manner prescribed. The outer sleeve is composed of rubber material which is commonly available and relatively inexpensive.

Notwithstanding the relatively low cost of manufacturing the subject paper managing assembly, the assembly provides a dependable and failsafe method for controlling and retaining the ends of continuous paper lines. The construction of the clamping bar member and the channels insures that the bar member will automatically rotate against the paper and hold it fixed within the channel. Further, the clamping bar member is easily removed from the channel of the base plate portion 6 so that paper can easily be fed upward through the channel. Thereafter, the bar member can be quickly inserted into the channel and pivots automatically downward to retain the paper in the base plate 4.

Finally, the forward extending support pads 8, 10, provide a support surface for the printer, permitting the rearward portion 6 of the base plate 4 to extend out over a table edge in cantilever fashion. Accordingly, the channel plate portion 6 is suspended and can receive from the bottom multiple lines of paper in the manner illustrated in Figure 2, free of interference from the table surface.

While the above describes the preferred embodiment of the subject invention, the scope of the present invention is not to be so restricted. Other embodiments, which will be apparent to those skilled in the art, and which utilize the teaching herein set forth, are intended to be within the scope and spirit of the subject disclosure.

We claim:

1. A paper feeding assembly for a computer printer or the like, comprising:

base plate means having at least one elongate channel extending therethrough, a forwardmost portion of said channel being defined by a forwardly inclined sidewall;

an elongate clamping bar residing within said channel pivotal freely under gravitational influence from a first position away from said inclined channel sidewall to a second clamping position against said inclined channel sidewall, whereby a length of paper, fed through a bottom channel opening and out a top channel opening, is pressured by the weight of said clamping bar against said channel sidewall and is thereby retained within said channel.

2. A paper feeding assembly according to claim 1, wherein said base plate having a top and a bottom surface and said channel having a V-shaped transverse profile tapering from said relatively wide top opening at said top surface to said relatively narrow bottom opening at said bottom surface.

3. A paper feeding assembly according to claim 2, wherein a rearward portion of said channel being defined by a vertical sidewall.

4. A paper feeding assembly according to claim 3, wherein said clamping bar having an intermediate portion positioned proximate to said top channel opening and having remote depending legs at opposite ends which extend downward in said channel to a position proximate said bottom channel opening.

5. A paper feeding assembly according to claim 4, wherein said clamping bar intermediate portion pivots about said end portions from a substantially vertical said first position to said second position.

6. A paper feeding assembly according to claim 5, wherein said clamping bar intermediate portion being of larger sectional dimension relative to said end portions, with said intermediate bar portion interfering with said vertical channel sidewall in said first position whereby inhibiting said bar member from achieving rotational equilibrium in said first position.

7. A paper feeding assembly according to claim 6, wherein said clamping bar being of a elongate cylindrical construction, with said intermediate portion having a larger diameter relative to said end portions.

8. A paper feeding assembly according to claim 7, wherein said intermediate portion having an outer sleeve composed of material having a high coefficient of friction.

9. A paper feeding assembly according to claim 8, wherein said clamping bar being freely removable from said channel top opening.

10. A paper feeding assembly according to claim 9, wherein said base plate having a forward extending portion for supporting automative equipment means into which said paper is fed.

11. A paper feeding assembly according to claim 10, wherein said base plate extension, anchored by said equipment means, is flatly positionable upon a work surface whereby said base plate extending from an edge of said work surface in cantilever fashion.

12. A paper feeding assembly for computer printers or the like, comprising:

a base plate having a top and a bottom surface and at least one profiled channel extending therethrough, said channel having a substantially V-shaped transverse profile tapering from a relatively wide top opening at said top surface to a relatively narrow bottom opening at said bottom surface; and said channel being defined by a rearward vertical sidewall and an upwardly inclined forward sidewall;

an elongate clamping bar member residing within said channel and having an intermediate portion positioned proximate to said top channel opening and remote depending legs at opposite ends of said intermediate portion extending downward in said channel to a position proximate said bottom channel opening; and said clamping bar intermediate portion pivoting downward about said end portions under gravitational influence from a substantially vertical first position adjacent said vertical channel sidewall to a second clamping position against said inclined channel sidewall, whereby a length of paper, fed through said bottom channel opening and out said top channel opening, is pressured by the weight of said intermediate clamping bar portion against said forward channel sidewall and is thereby retained within said channel.

13. A paper feeding assembly according to claim 12, wherein said clamping bar intermediate portion being of larger sectional dimension relative to said end portions, with said intermediate bar portion interfering with said vertical channel sidewall in said first position whereby inhibiting said bar member from achieving rotational equilibrium in said first position.

14. A paper feeding assembly according to claim 13, wherein said clamping bar being of a elongate cylindrical construction, with said intermediate portion having a larger diameter relative to said end portions.

15. A paper feeding assembly according to claim 14, wherein said intermediate portion having an outer sleeve composed of material having a high coefficient of friction.

16. A paper feeding assembly according to claim 15, wherein said clamping bar being freely removable from said channel top opening.

17. A paper feeding assembly according to claim 16, wherein said base plate having a forward extending portion for supporting automative equipment means into which said paper is fed.

18. A paper feeding assembly according to claim 17, wherein said base plate extension, anchored by said equipment means, is flatly positionable upon a work surface whereby said base plate extending from an edge of said work surface in cantilever fashion.

* * * * *